United States Patent [19]

Freese et al.

[11] 4,167,979

[45] Sep. 18, 1979

[54] C-FRAME ASSEMBLY FOR BULLDOZER

[75] Inventors: Gary P. Freese; Clifton D. Wheeler, both of Joliet, Ill.

[73] Assignee: Caterpillar Tractor Co., Peoria, Ill.

[21] Appl. No.: 863,487

[22] Filed: Dec. 22, 1977

[51] Int. Cl.[2] ..... F02B 3/76

[52] U.S. Cl. ..... 172/801; 172/805; 403/67; 403/79

[58] Field of Search ..... 403/67, 79, 150; 172/801-808

[56] References Cited

U.S. PATENT DOCUMENTS

| | | | |
|---|---|---|---|
| 2,059,431 | 11/1936 | Barrett | 172/804 |
| 2,274,904 | 3/1942 | Lawler | 172/808 |
| 3,006,090 | 10/1961 | Gwinn | 172/808 |
| 3,016,635 | 1/1962 | Aston | 172/808 |
| 3,134,605 | 5/1964 | Cadiou | 403/67 |
| 3,185,511 | 5/1965 | Wochner | 172/805 |

*Primary Examiner*—Richard J. Johnson

*Attorney, Agent, or Firm*—Wegner, Stellman, McCord, Wiles & Wood

[57] ABSTRACT

In an angled bulldozer blade and tractor assembly, a C-frame is constructed in two parts with interfitting elements at the midportion of the C-frame which are held together by axially aligned bearings or sleeves. A blade pivoting pin extends through the midportion of the interfitting elements with the axis of the pin lying transverse to the axis of the aligned bearings or sleeves. Parts of the interfitting elements of the connection are shaped to permit relative rotation between the two halves of the C-frame, particularly for use during storage and shipment of the C-frame.

9 Claims, 4 Drawing Figures

C-FRAME ASSEMBLY FOR BULLDOZER

BACKGROUND OF THE INVENTION

1. Field of the Invention

In an angled bulldozer blade and tractor combination having a C-frame and, in particular, an improved connection between the two halves of the C-frame.

2. Description of the Prior Art

At one time, and for certain applications even today, C-frames are constructed substantially of one piece. This has resulted in problems in shipment of the C-frame and in manufacturing the C-frame in such a way that the trunnion mountings at each end of the arms of the C-frame are in a common plane for attachment to the tractor. An improvement was adopted sometime ago wherein the C-frame was broken just to the right or to the left of the midportion of the C-frame and flanges were fixed on the opposite ends of the two halves of the C-frame which could then be bolted together for use or unbolted for storage and shipment. This had a disadvantage in that the holes in the respective flanges had to be carefully aligned with the reference points for the trunnion mountings at the ends of the arms to be sure that the C-frame, when assembled, could be assembled to the tractor. The C-frame with the flanged and bolted halves must be taken apart for shipment and reassembled in the field. The bolted joint causes manufacturing problems in that the holes for the joint must be aligned in both halves so that when they are bolted together the dimension across the ends of the arms of the C-frame is fixed and must match the tractor. In order to ensure a good joint, all of the bolts must be kept tight and where the bolts are put in in the field, it is almost impossible to ensure proper installation torques. Also, since the C-frame is, in effect, one piece after being bolted together, the sharing of side loads from left to right or from right to left is not positive.

In an attempt to provide a means for positively aligning the two halves of the C-frame, structure has been proposed whereby tapered shear sleeves are bridged across the juncture between the two halves prior to bolting the two halves together which, presumably, better aligns the two halves and provides a stronger sheer plane between the two halves. This is relatively expensive, requires very accurate machining and still does not assure that the spacing between the halves will be accurate or that the planes of the two halves will coincide with the mounting.

A pivot mounting between the two halves has been proposed whereby the pin for mounting the blade to the C-frames is connected directly to the spacer between the two halves and surrounding the pivot pin. This device has the disadvantage that for shipment, the pin is removed and must be stored separately which always raises the possible problem of losing the pin. Secondly, this construction provides for the blade lift connection being an integral part of the joint between the two halves of the C-frame. This reduces the flexibility of the connection between the two halves of the C-frame, and requires added space between the tractor and the C-frame for the connection for the lift arrangement. In addition, the trunnion mounting for the lift assembly is a loose item which must be disassembled and stored separately when the two halves of the trunnions are separated. Also, with the trunnion mounted between the two halves at the pivot connection of the C-frame, the two halves of the C-frame cannot be easily adjusted to fit the mounting on the track roller frame.

SUMMARY OF THE INVENTION

The present invention is directed to overcoming one or more of the problems as set forth above.

According to the present invention, the C-frame is divided into two halves with interfitting segments or elements at the common terminal ends thereof. Pivot pins or sleeves interfit between the interfitting segments or elements of the halves and are affixed thereto so that the two halves of the C-frame can be pivoted about a common axis. Bearing surfaces for a pivot pin for mounting the blade to the C-frame extend transverse to the axes of the sleeves and cross the common axis of the sleeves at right angles thereto. Separate trunnion mounts are provided on each half of the C-frame for connection to lift cylinders for raising and lowering the blade.

The two halves being pivotally affixed together, have no pins to lose during shipment or storage. By using separate trunnions for mounting the ends of the lift cylinders, there are no removable trunnion mounts at the juncture of the two halves, which, likewise, can be lost during shipment or storage. Since the two halves are pivotally connected together, it is not necessary to maintain an exact spacing between the free ends of the two halves for mounting the free ends on the tractor, since the distance between the free ends can be varied about the common axis of the sleeves. The pivoting of the two halves in the manner specified ensures equal side loading on each half of the C-frame, which overcomes many of the problems inherent in the prior art constructions.

BRIEF DESCRIPTION OF THE DRAWINGS

The details of construction and operation of the invention are more fully described with reference to the accompanying drawings which form a part hereof and in which like reference numerals refer to like parts throughout.

In the drawings.

DESCRIPTION OF THE PREFERRED EMBODIMENT

Figure 1:
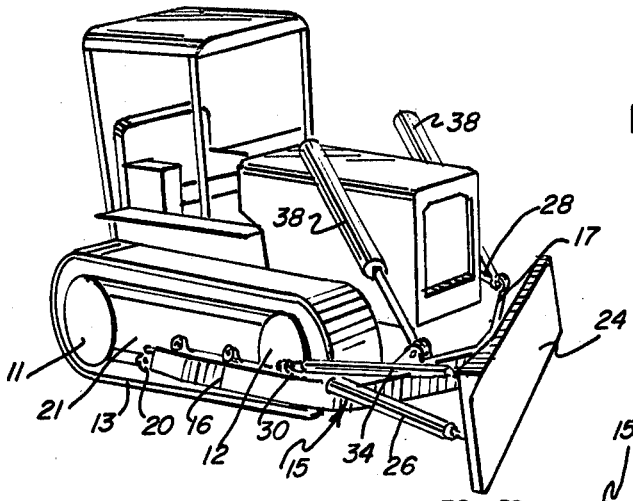
FIG. 1 is a perspective view of a tractor upon which is mounted a C-frame and a blade according to the present invention.
Figure 2:
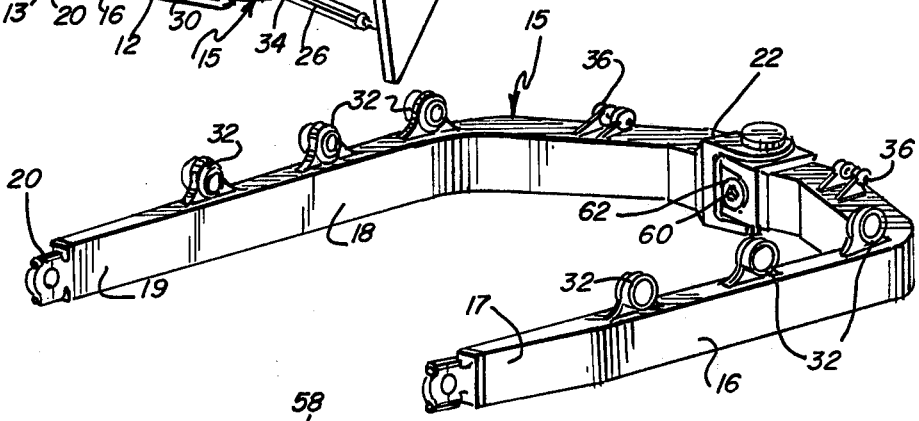
FIG. 2 is a perspective view of the improved C-frame.

Referring broadly to FIGS. 1 and 2, a tractor 10 has a drive sprocket 11 and an idler wheel 12 about which is drivingly mounted a continuous track 13. A C-frame 15 is comprised of two side arms or halves 16 and 18 with the rear end portions 17,19, respectively, of the side arms being pivotally connected through trunnion sockets and retainers 20 to a trunnion carried by a track roller frame 21. The C-frame 15 is connected to the exterior of the track roller frame 21 and has the midportion 22 of the C-frame 15 pivotally connected to the lower midportion of the rear of the bulldozer blade 24.

Thrust members 26 and 28 are connected to the lower rear corner portions of the blade 24 and have brackets 30 that are pivotally connected to appropriate socket members 32 carried on the upper surfaces of the two halves or arms 16,18 of the C-frame. Three socket members 32 are provided on the top surface of each half 16,18 of the C-frame 15 in substantially equally spaced apart relationship. Each thrust member 26,28 has a tilt strut 34 extending from the bracket 30 and being connected to the upper rear corner portions of the blade. The thrust members 26,28 and brackets 30 are used to give the blade 15 the angled position desired and the tilt struts 34 are used to give the blade the tilt position desired.

A pair of trunnion mounts 36 are attached to the top surfaces of the two halves or sides 16,18 of the C-frame 15 in equally spaced relationship from the middle of the C-frame. A pair of lift cylinders 38 are carried by the tractor 10 and have the ends of the rods of the cylinders being pivotally connected to the trunnion mounts 36 on the C-frame. The lift cylinders 38 are used to raise and lower the front of the C-frame 15 and the bulldozer blade 24.

Figure 3:
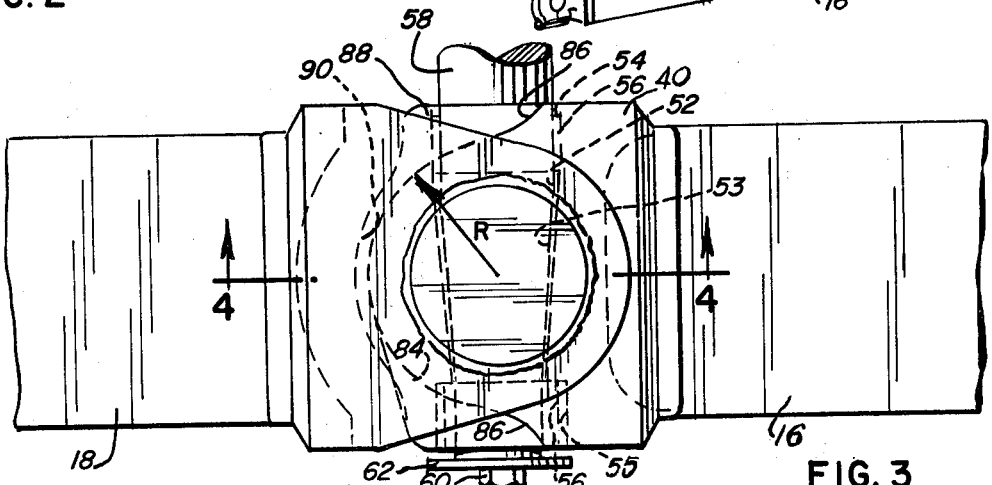
FIG. 3 is an enlarged plan view of the center section of the C-frame of FIG. 2; and, FIG. 4 is a cross-sectional view taken along the line 4—4 of FIG. 3.
Figure 4:
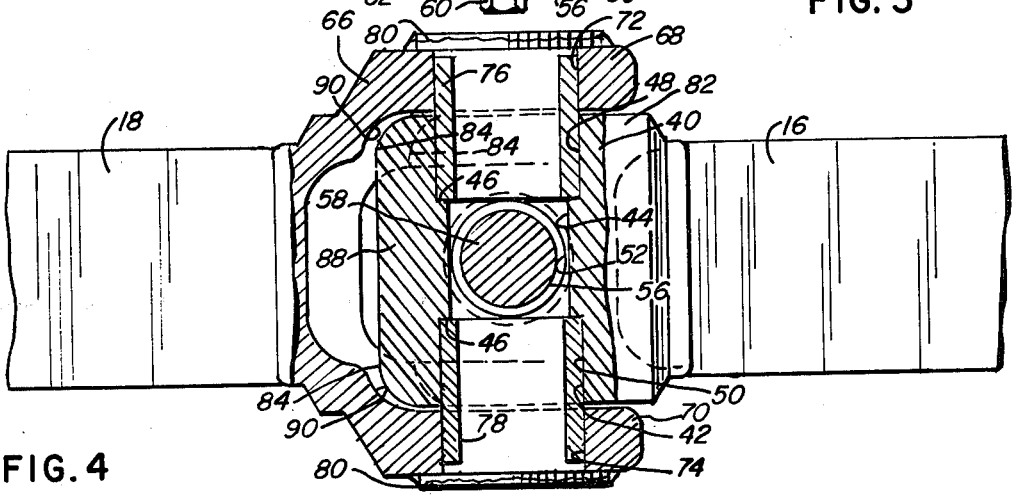

Referring specifically to FIGS. 3 and 4 and, in particular, as they relate to FIG. 2, side half 16 has an enlarged element or section 40 extending axially therefrom. The enlarged element or section 40 has a vertically disposed stepped bore 42 such that the midportion 44 of the bore has a reduced diameter which creates a pair of outwardly and oppositely facing shoulders or abutments 46 at the bottom of the enlarged diameter end portions 48,50. Along an axis disposed at right angles to the axis of the bore 42 is a transverse bore or aperture 52 which tapers 53 at the midportion from an enlarged diameter end portion 54 at the front of the C-frame to a reduced diameter end portion 55 at the rear of said C-frame. The diameter at the midportion of the taper 53 is smaller than the diameter of the midportion 44 of the bore 42 and smaller than the axial length of said midportion 44 of bore 42. The end portions 54,55 of the bore or aperture 52 are slightly enlarged to receive bushings 56 through which a pivot pin 58 passes. Pivot pin 58 is tapered in the midportion to mate with the tapers 53 in the bore 52. The pivot pin 58 passes through the element 40 and is prevented from escaping from element 40 by an overhanging washer 62 being held by bolt 60 against the end face of the pin 58. When the tapers in pin 58 and bore 52 engage, the washer 62 will be spaced from the end face of the element 40 as shown in FIG. 3. The inner end of the pin 58 in FIG. 3 is shown broken away but, in fact, it extends to and has a pair of outwardly extending, parallel spaced apart plates which are adapted to be pivotally connected to a lug on the rear of the bulldozer blade. The blade 24 pivots about the longitudinal axis of the pin 58 to assume various tilt positions relative to the C-frame. It is to be understood that various commercially available universal-type connections could be used between the C-frame and the center of the blade such as a ball and socket, a ball bushing, a single-ear universal or a two-ear universal arrangement would be operative.

The side arm or half 18 has a bifurcated element 66 including a pair of outwardly extending spaced apart legs 68,70 formed integrally with the end of the arm 18. The respective legs 68,70 of the element 66 straddle the element 40 on side arm or half 16 and have openings 72,74 therein which are axially aligned with each other and with the openings 48,50 in the element 40. A pair of bearing sleeves 76,78 are inserted through the aligned openings 72,48 and 74,50 in the elements 66 and 40 and bottom on the abutments or shoulders 46 in the bore 42. The bearing sleeves 76,78 bridge the opening between the bifurcated legs 72,74 and the element 40. Caps or plates 80 are positioned on the opposite sides of the bifurcated legs 68,70, which plates or caps are welded to said legs 68,70. The sleeves 76,78 do not extend the full distance between shoulders 46 and caps 80 and may be press fit into portions 48,50 of bore 42 in element 40 and may be clearance fit into openings 72,74 in the legs 68,70. With the bearing sleeves 76,78 bearing against the shoulders 46 formed in the bore 42 in the solid element 40 and with the plates or caps 80 welded to the outer surface of the legs 68,70 of the bifurcated element 66, it will be clear that the bearing sleeves 76,78 are trapped therebetween and serve as permanent pivots for the two side arms or halves 16,18 of the C-frame. The axis of the pivot pin 58 lies transverse to and crosses the axis of the pivot sleeves 76,78 so that the two halves of the C-frame pivot about the vertical axis of the sleeves 76,78 and the blade 24 pivots about the horizontal axis of the pin 58. The bearing sleeves 76,78 are shown in two parts, but it should be understood that a single sleeve could be used thereby eliminating the shoulders 46 in the opening 42. If a single sleeve is used, a centered clearance hole would be formed therein to permit the cross pin 58 to pass through. It is also possible to have the sleeves 76,78 in the form of a pin which would pass through the legs 68,70 and element 40 along an axis offset from the axis of the pin 58.

Since the openings 72,74 in the bifurcated arms and the bore 42 with portions 48 and 50 in the solid element 40 of the C-frame 15 are preformed or drilled in the factory, the accuracy of the locations of the openings can be rather precisely maintained without complication so that the bearing sleeves 76,78 can be inserted and secured in place by the welded caps 80 without undue complication or expense. With the two side arms or halves 16,18 pivoted relative to each other about the vertical axis of the sleeves 76,78, the trunnion bearing ends 17,19 of the two side arms or halves 16,18 can be brought together for checking alignment and for shipment. With the ends 20 properly aligned, there is no problem in opening the ends 17,19 of the halves 16,18 to the proper spacing for attachment to the track roller frame 21 of the tractor.

A C-frame 15 that is to be mounted on a tractor 10 will be unloaded from a flatcar, or the like and the trunnion bearing ends 17,19 of the two halves like, will be separated by pivoting one relative to the other about the axis of the bearing sleeves 76,78. The trunnion bearing ends 17,19 will be secured with trunnions carried by the track roller frame 21. The pivot pin 58, which is either preassembled in the bore 52 in element 40 or will be assembled therewith, will be inserted through the bearings in the solid element 40 and will be secured in position relative thereto by means of the bolt 60 threaded into the end of the pin 58 which will urge the washer 62 against the side of the solid element 40. The other end of the pivot pin 58 will have its bifurcated portion straddle the lug carried by the rear of the blade 24 whereupon passing a pin through the bifurcated portion and the lug will secure the C-frame 15 to the blade. Lift cylinders 38 are connected to the trunnion mounts 36 carried by the top surfaces of the two side arms or halves 16,18 of the C-frame 15 so that the blade 24 and C-frame 15 can be raised and lowered about the pivot axis passing through the trunnions on the trunnion bearing ends 17,19 of the arms 16,18 of the C-frame.

So as to permit the side arms or halves 16 and 18 to pivot relative to each other about the axis of the bearing sleeves 76,78, the solid element 40 has the sides of the enlarged central portion 82 cut or molded away along a circular wall 84 centered at the axis of the sleeves 76,78. As viewed in FIG. 3, the circle defining the wall 84 has a radius R, which wall 84 gradually tapers outward at 86 to merge with the side faces of the element 40. The wall 84 abuts against the enlarged midportion 88 of the element 40. The other side arm or half 18 of the C-frame 15 has the legs 68,70 of the bifurcated element 66 hollowed in the center portion thereof as shown in FIG. 4 to provide walls 90 which are curved inward in the midportion as viewed in FIG. 3. The walls 90 of the element 66 are spaced from the walls 84 of element 40 and, due to the circular shape of the walls 84, the element 40 can be pivoted relative to the element 66 without the enlarged portions 82 of element 40 contacting the adjacent parts of element 66. The midportion 88 of the element 40 nests in the spaced area between the legs 68,70 of the element 66. The cut away sections defined by walls 84 and the aligned wall 90 of element 66 are made in such a way as to provide maximum strength to the joint and still permit freedom of movement between the ends of the two side arms or halves 16,18 of the C-frame 15 so that the two side arms or halves 16,18 can be pivoted about the axis of the sleeves 76,78 to define the smallest possible outer periphery for storage and/or shipment.

The embodiment of the invention in which an exclusive property or privilege is claimed is defined as follows:

1. In a C-frame for attaching a bulldozer blade to a tractor frame, said C-frame having two halves, a first element outwardly extending from one end of one of said halves, a bifurcated element having a pair of legs outwardly extending from one end of the other of said halves, said legs of the bifurcated element straddling said first element, openings formed through the legs of the bifurcated element, a bore formed in the first element in axial alignment with said openings in the legs of the bifurcated element, a separate means extending through the opening in each leg of the bifurcated element and extending at least partially through the bore in said first element whereby said one half is pivotally mounted relative to said other half, an opening extending through said first element having an axis lying transverse to the axis of the bore, and a mounting pin passing through said opening in said first element and being adapted to be pivotally secured to the rear of a blade to attach the blade to the C-frame.

2. In a C-frame as claimed in claim 1 wherein each separate means is a sleeve and wherein abutments are provided in said bore in the first element against which said sleeves will abut, said abutments being spaced apart on opposite sides of said opening extending transverse to said bore.

3. In a C-frame as claimed in claim 2 wherein a cap is secured to the outer surfaces of the legs of the bifurcated element in overlapping relationship to the sleeves in the openings in said legs to retain said sleeves in said openings.

4. In a C-frame as claimed in claim 3 wherein said caps are secured by welding.

5. In an angled bulldozer blade mounting assembly, a C-frame divided into two halves, one of said halves having an outwardly extending element, said other half having a bifurcated element with a pair of legs outwardly extending from the end thereof, said bifurcated legs straddling the element of the first half, aligned openings formed through the bifurcated legs and extending into the element of the first half, sleeve means inserted in the opening in each leg and extending into the opening in the element of the first half, means for retaining the sleeve means in position relative to the two halves of the C-frame, an opening in said element of the first half and having an axis extending transverse to the axes of the sleeve means and a pivot pin passing through said opening in said element of the first half and being secured to the rear of said blade to attach the C-frame to said blade.

6. In an angled bulldozer blade mounting assembly as claimed in claim 5 wherein abutments are formed in said openings in said element of the first half against which said sleeve means abut to position said sleeve means relative to said element of the first half.

7. In an angled bulldozer blade mounting assembly as claimed in claim 6 wherein said means for retaining said sleeve means comprises a cap secured to said legs for holding said sleeve means in said openings.

8. In an angled bulldozer blade mounting assembly, a C-frame divided into two halves, an outwardly extending element carried by one of said halves, a bifurcated element having legs outwardly extending from the other of said halves, said legs of the other half straddling said outwardly extending element of the first half, axially aligned openings formed through the legs of the bifurcated element, axially aligned openings formed inwardly from opposite sides of said outwardly extending element, said openings in the legs aligning with said openings in said outwardly extending element, abutments formed in said openings in said outwardly extending element, bearing sleeves nested in said aligned openings and engaging said abutments, caps welded to said legs over the ends of said bearing sleeves to retain the sleeves in position relative to the two halves of the C-frame, another opening in said outwardly extending element having an axis extending transverse to the axes of the bearing sleeves and a pin passing through said another opening and being secured to the rear of said blade to attach the C-frame to said blade.

9. In an angled bulldozer blade mounting assembly as claimed in claim 8 wherein said axis of said another opening crosses the axis of said aligned openings whereby said pin passes between the aligned bearing sleeves.

* * * * *